United States Patent [19]

Shaffer et al.

[11] 4,062,616

[45] Dec. 13, 1977

[54] FLAT FLEXIBLE CABLE CONNECTOR ASSEMBLY INCLUDING INSULATION PIERCING CONTACTS

[75] Inventors: Howard Richard Shaffer, Westminister, Md.; John Aaron Zimmerman, Jr., Hershey, Pa.

[73] Assignee: AMP Incorporated, Harrisburg, Pa.

[21] Appl. No.: 715,770

[22] Filed: Aug. 19, 1976

[51] Int. Cl.[2] ..... H01R 13/38

[52] U.S. Cl. ..... 339/99 R

[58] Field of Search ..... 339/97–99

[56] References Cited

U.S. PATENT DOCUMENTS

| | | | |
|---|---|---|---|
| 3,820,055 | 6/1974 | Huffnagle et al. | 339/97 P |
| 3,824,530 | 7/1974 | Roberts et al. | 339/99 R |
| 3,879,099 | 4/1975 | Shaffer | 339/99 R |
| 3,899,236 | 8/1975 | Santos | 339/98 |
| 3,932,018 | 1/1976 | Parsons et al. | 339/99 R |

*Primary Examiner*—Joseph H. McGlynn
*Attorney, Agent, or Firm*—Russell J. Egan

[57] ABSTRACT

A connector assembly is disclosed for terminating multi-conductor flat flexible cable with contacts which pierce the insulation to make good electrical and mechanical engagement with all types of multi-conductor cable conductors, in particular, round wire and stranded wire conductors. Each contact is die stamped from sheet material and has a body portion with a pin or socket electrical termination means extending from one side and a cantilever arm extending from the other side with a forked projection on the free end thereof. The forked projection is angularly offset with respect to the plane of the contact and substantially normal to the longitudinal axis of the arm. The connector assembly includes a multi-part housing including a contact block mounted in a housing shell and a pair of mating housing members pivotally mounted in the housing shell and adapted to close driving the forked projection of the contact through the associated cable to grip the other of the housing members thereby securely holding the assembly together.

13 Claims, 10 Drawing Figures

Fig. 4
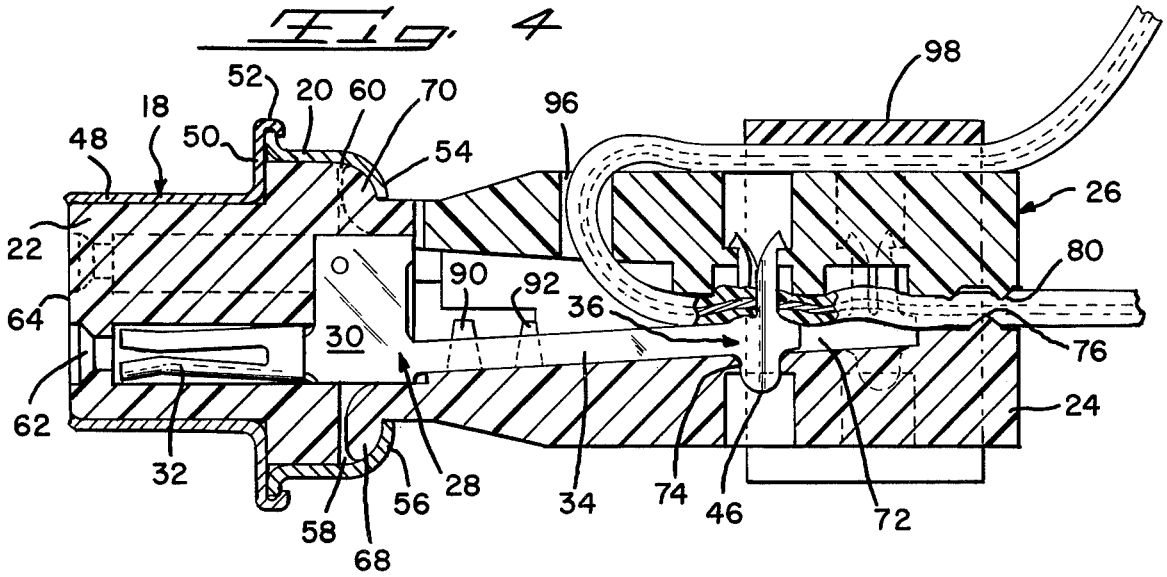
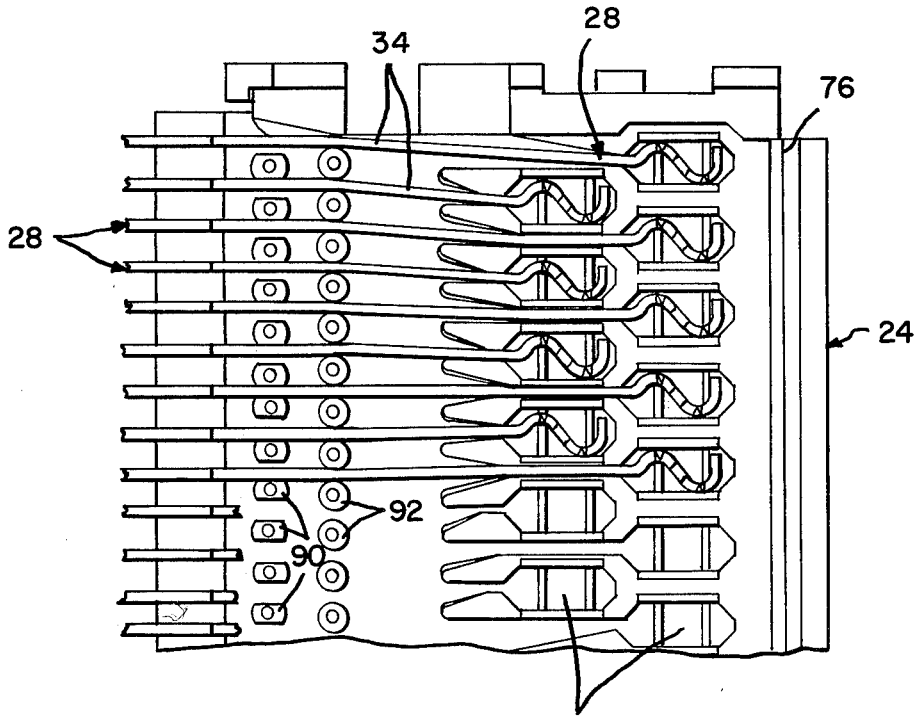
Fig. 5

FLAT FLEXIBLE CABLE CONNECTOR ASSEMBLY INCLUDING INSULATION PIERCING CONTACTS

BACKGROUND OF THE INVENTION

1. The Field Of The Invention

The present invention relates to an improved multi-conductor flat flexible cable connector assembly and in particular to an insulation piercing contact capable of making good mechanical and electrical engagement with all types of conductors, including round wire and stranded wire, while engaging the mating housing member in a secure fashion.

2. The Prior Art

There are many problems involved in providing good electrical termination for flat flexible cable, particularly cable having round wire or stranded wire conductors. Most of the known termination methods and contacts have required some sort of insulation stripping or other cable preparation prior to the attaching of the contacts. Many of the known contacts that can be applied directly through the cable insulation have not been able to provide satisfactory mechanical and electrical engagement with the conductors of the cable. This has been the case particularly in instances where the cable conductors are round wires or stranded wires. Insulation piercing contacts have a tendency to unwind stranded wire, so that good mechanical engagement cannot be made, and to sever either the round or stranded wire, with the various delitarious effect to the cable. The primary advance in this the known prior art is represented by U.S. Pat. No. 3,879,099. The present application represents a direct improvement over the above-mentioned U.S. patent.

SUMMARY OF THE INVENTION

The subject connector assembly has a plurality of insulation piercing contacts. Each contact includes a base portion having a pin or socket mating portion extending from a first side and a cantilever beam extending from the other side. A forked projection is on the free end of each cantilever arm and is angularly offset to the plane of the contact and cammed with respect to the initial axis of the arm to engage the conductor along a plane substantially normal to the plane defined by the conductors on the cable. The connector housing includes a contact receiving block and two mating housing members pivotally attached to the receiving block. One of the mating housing members receives the arms of the contacts while the other of the mating housing members receives the forked projections and is gripped thereby into a locking arrangement with the housing. Each mating housing member also has interengaging means extending normal to the axis of the cable to provide strain relief means therefor.

It is an object of the present invention to construct an insulation piercing contact and connector assembly which can be used to terminate multi-conductor flat flexible cable and which can be applied to said cable without the use of special tooling.

It is another object of the present invention to produce an insulation piercing contact and connector assembly for use in terminating multi-conductor flat flexible cable in which the contacts pierce the insulation of the flat flexible cable during the attachment of the connector thereto and make good mechanical and electrical engagement with the cable conductors.

It is a further object of the present invention to construct an insulation piercing contact and connector assembly for terminating flat flexible cable having round conductors of either single or multi-strand configuration.

It is yet another object of the present invention to produce an insulation piercing contact and connector assembly which may be used to terminate flat flexible cable and is matable with similar existing terminal connectors.

The foregoing objects and other advantages of the present invention will become readily apparent to those skilled in the art from the following detailed description taken with reference to the accompanying drawings.

BRIEF DESCRIPTION OF THE DRAWINGS

FIG. 4 is a vertical section, similar to FIG. 3, showing the subject connector assembly secured to a multi-conductor flat flexible cable intermediate the ends thereof;

FIG. 5 is a top plan view of the lower mating housing member with some of the contacts positioned therein;

DETAILED DESCRIPTION OF THE PREFERRED EMBODIMENT

Figure 1:
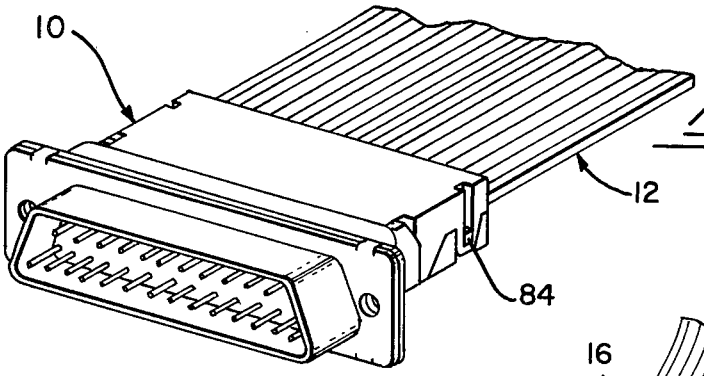
FIG. 1 is a perspective view of the subject connector assembly fixed to one end of the multi-conductor flat flexible cable.
Figure 2:
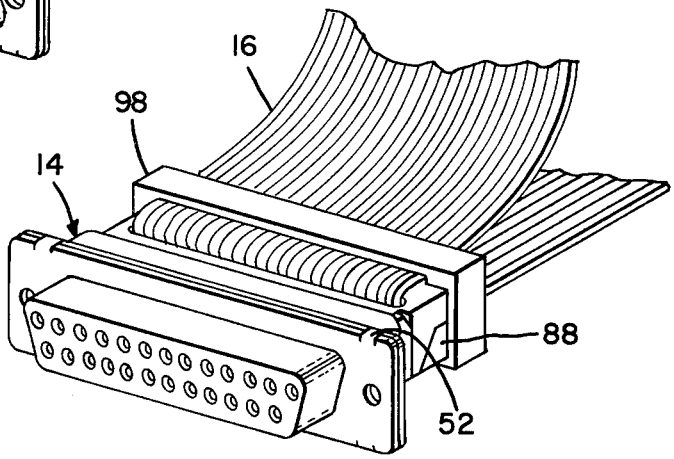
FIG. 2 is a perspective view of the subject connector assembly fixed intermediate the ends of a multi-conductor flat flexible cable in daisy chain fashion.

The subject connector assembly 10 is shown in FIG. 1 attached to and forming an end termination of multi-conductor flat flexible cable 12. The connector assembly 14 is shown in FIG. 2 is attached intermediate the ends of a multi-conductor cable 16 to form a daisy chain configuration. In each instance the connector assembly is substantially identical and includes a two-part housing shell 18, 20, a contact block 22, secured within the shell members 18, 20, a pair of mating housing members which are the bottom 24 and the top 26, and a plurality of contacts 28.

Figure 10:
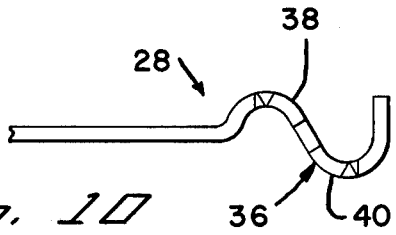
FIG. 10 is a top plan view of the forked projection of FIG. 9.
Figure 9:
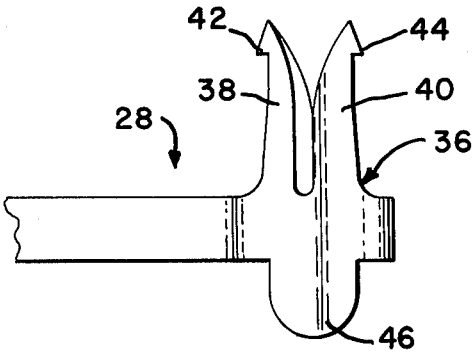
FIG. 9 is a detailed side elevation of the forked projection on the free end of the subject contact.

Each contact 28 includes a body portion 30 with a mating portion 32 extending from a first side thereof. In the case shown the mating portion is a receptacle but it is clearly within the preview of the invention to have this member of any matable configuration. A cantilever arm 34 extends from another side of the body portion 24 and has on its free end a forked insulation piercing projection 36 which includes a pair of prong members 38, 40 having on their free ends insulation engaging detents 42, 44, respectively. Extending in the opposite direction from the forked projection is a mounting tine 46. It should be noted that the forked insulation piercing projection is not aligned with the otherwise planar contact but has a rolled configuration as best shown in FIGS. 5 and 10. It should also be noted that adjacent contacts 28 have cantilever arms 34 of different lengths so that the forked projections form two parallel rows. This allows for use of the contacts on closer centers than what would otherwise be possible. Having only two lengths of the contact arms also does not produce an excessive number of contacts to make the subject invention unwieldy to either manufacture or assemble.

The metallic housing shell 18 includes a forwardly directed hood portion 48 and a radial flange 50. In the embodiment shown, the hood 48 merely encloses the contact block 22 but in the embodiment employing pin contacts, such as shown in FIG. 1, the hood portion would surround and protect the electrical terminals 32 of the contacts 28. The rear shell 20 is secured to the hood portion by conventional means, such as the tabs 52. The rear shell 20 includes inwardly directed arcuate flanges 54, 56 which, together with the rear portion of the contact lock 22, define lower and upper channels 58, 60, respectively. The contact block 22 has a plurality of contact receiving bores 62 extending from the front face 64 to the rear face 66 to receive the contacts 28 therein. The mating housing members 24 and 26 each have an arcuate lip 68, 70 adapted to be received in the lower and upper channels 58, 60, respectively.

Figure 3:
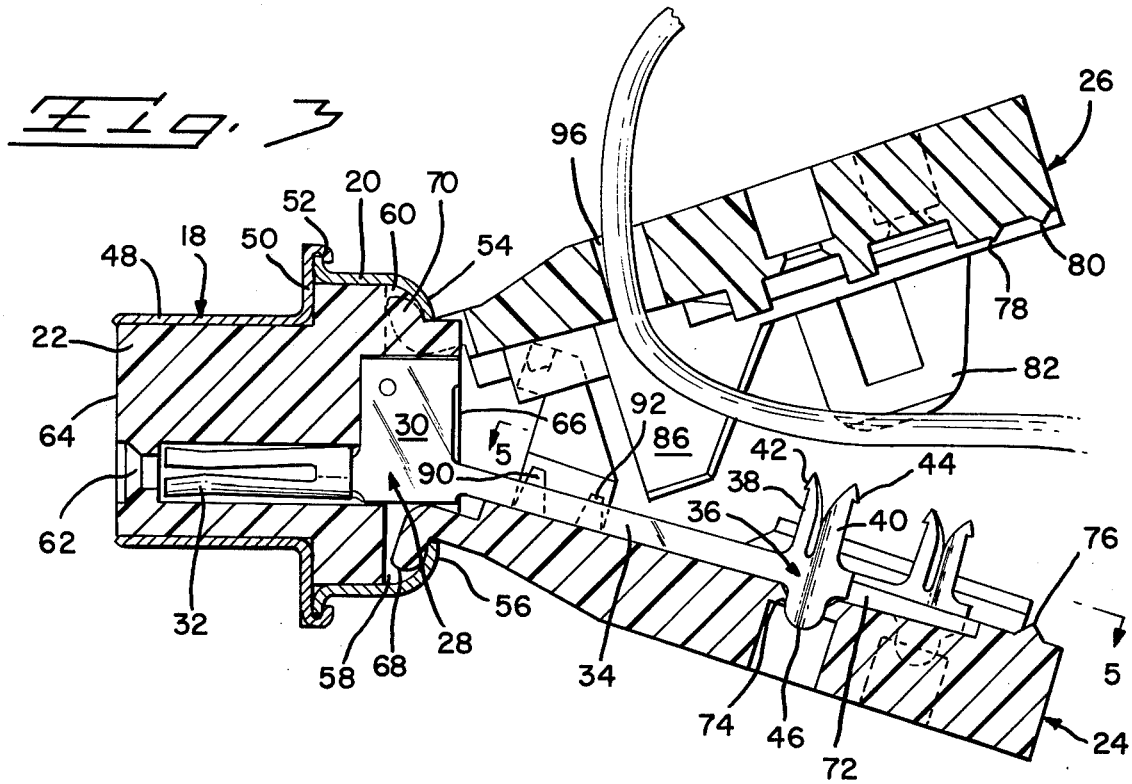
FIG. 3 is a vertical section through the subject connector assembly in the open condition ready to be attached to a flat flexible cable as shown in FIG. 2.
Figure 6:
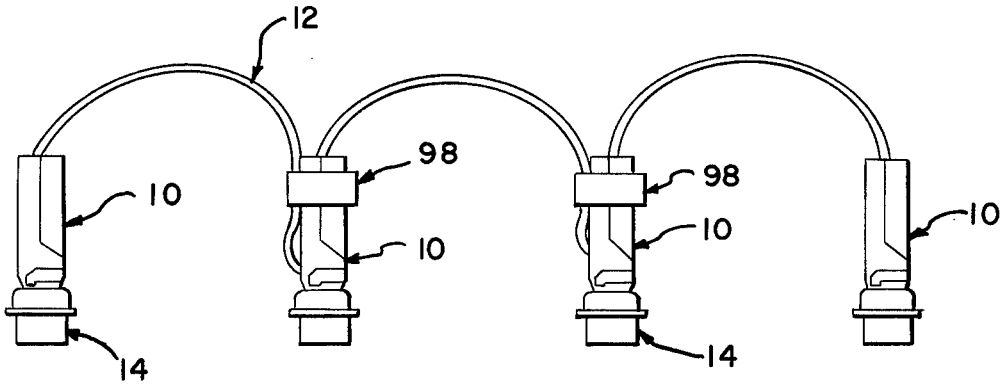
FIG. 6 is a diagrammatic representation of the subject connector in a daisy chain configuration.
Figure 7:
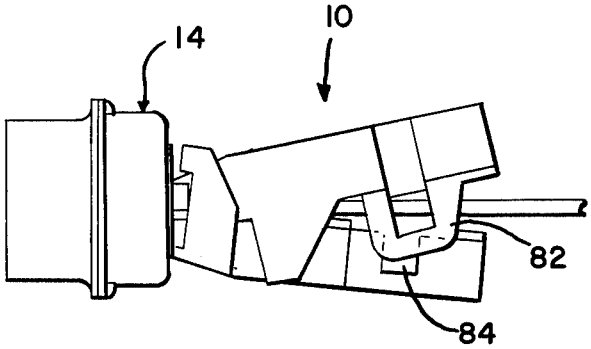
FIG. 7 is a side elevation of the subject connector assembly showing the mating housing members in an open condition.
Figure 8:
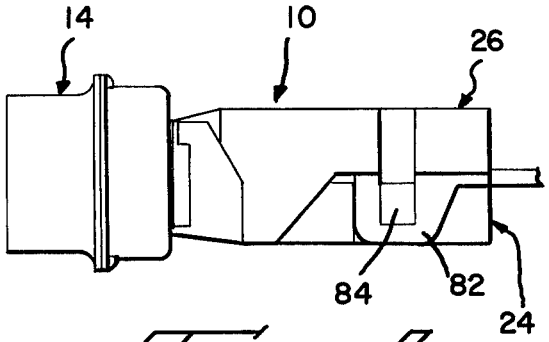
FIG. 8 is a side elevation, similar to FIG. 7, showing the mating housing members in the closed and locked condition.

In the embodiment of the subject connector shown in FIG. 3, it should be noted that the lips 68, 70 and channels 58, 60 are asymmetric with the top channel and lip being somewhat shorter than the bottom channel and lip. The upper mating housing member 26 is shorter than the bottom mating member and is provided with a central keying aperture to prevent improper assembly of the housing members. The lower housing member 24 is also provided with a plurality of contact receiving grooves 72 extending into blind end recessed 94. There are also a like plurality of apertures 74 near the inner ends of the grooves and communicating with the grooves to receive the mounting tines 46 of the respective contacts. The mating housing members have inter engaging transversely extending strain relief projections 76, 78, and 80 at the end opposite lips 68, 70 and interengaging locking means 82, 84. They are further provided with interengaging guide means 86, 88 which serve to guide the cable so that the proper conductor is aligned with the proper contact.

The lower housing member 24 has a plurality of contact receiving areas in which the arms of the contacts are frictionally received. Each area includes an arm channel defined by studs 90, 92, groove 72 in the housing member and an enlarged profiled end recess 94. The channels are of two different lengths so that the adjacent enlarged profiled recesses are offset thus allowing the contacts to be more closely spaced.

In the embodiment shown in FIGS. 2 and 3, the upper mating housing member 26 includes a cable passageway 96 through which the cable 16 is passed and a cable dressing member 98 which is received over the end of the closed mating members to dress the cable against the connector.

The subject contact and connector are assembled in the following fashion, the receptacle block 22 is preloaded with a plurality of contacts 28 with the electric connection terminals 32 extending at least to the front face thereof and the contact body 30 being held in the slitted rear portion of the block. The hood portion 48 of the housing shell 18 and the rear portion 20 are assembled over the pre-loaded contact block and secured together by the tabs 52. The mating housing members 24, 26 are pivotally attached to the assembly by insertion of their respective lip portions 68, 70 into the respective channel portions 58, 60. The arms 34 of the contacts 28 are frictionally engaged in the recesses in the lower member 24. The friction developed between the plurality of contact arms and the mating housing member is sufficient to hold the mating housing member in the assembly in its open position. The thus completed assembly is shipped in this fashion and subsequently assembled with a flat flexible cable by inserting the cable between the open housing members and above the contact arms, as shown in FIG. 3. When the cable is fully inserted in the housing, the mating housing members are brought together until the locking means engage and the strain relieving members grip the cable. During this closing of the mating members, the conductors of the cable are driven into the forked members which displace the surrounding insulation and make contact with the conductor. The contacts also extend into the top mating housing member to lockingly engage therewith, as shown in FIG. 4, as thus further secure the connector together. As the mating housing members are brought together they drive the arms 34 of the contacts a short distance which causes the lance shaped ends of the forked projections to pierce the insulation of the cable and form a closed configuration surrounding the conductor of the cable so that they will be firmly engaged.

It should also be noted that the forward edge of the upper mating member 26 is preferably designed to lock the contacts in the contact block, when the members themselves are locked together, by preventing rearward movement of the contacts. This locking of the contacts against axial movement is in addition to that accomplished by the arms lying in the retaining slots.

The subject connector assembly provides a ready means for attaching terminals to flat flexible cable including cables with round conductors. The connector assembly allows for all contacts to be engaged with the cable at one time and with a single movement. No tools or special equipment are required to effect the connection and pin and socket patterns can be arranged for mating with existing connectors. The contacts are insulation piercing so that there is no requirement for stripping or preparation of the wires. The cable is tightly gripped between the portions of the housings so that there is a provision for strain relief of the cable. The forked projections of the subject contact pierce the cable insulation from a single side of the conductor and proceed to grippingly engage the opposite mating housing member. The forked projections have an angular displacement with respect to the longitudinal axis of the contact to result in an entwining configuration of the conductor. Movement of the conductor is controlled preventing the conductor from being unduly bent or severed, if it is a stranded wire conductor. The result is good penetration by the forked projections and good locking of the contact and cable in the connector.

One of the problems of making a connector assembly for terminating flat flexible cable and still mating with existing connectors is the difference between the center line distances of the cable conductors and the contacts. In one case the difference may be minimal and wherein another case it may be a critical factor. This means that the contacts may not be aligned with the conductors in all cases. In order to overcome this the two mating halves of the connector housing may be designed with the contact slots diverging towards the free end or converging as shown in FIG. 5. The contacts thus can be positioned directly over each conductor of the cable while providing the desired spacings of the contacts.

The cable dressing member 98 shown in FIG. 2 is merely an example of the type of member that can be utilized with the present invention. This is simply a piece of stiffly resilient plastics material that will encompass three sides of the mating members with the flanges that will grip the fourth side. Clearly other configurations could be applied without departing from the invention.

The present invention is subject to many modifications and variations without departing from the spirit or essential characteristics thereof. The present embodiments should therefore be considered in all respects as illustrative and not restrictive.

What is claimed is:

1. A connector assembly for terminating flat flexible cable having a plurality of insulated conductors comprising:

a contact block having a plurality of through passages therein;

a like plurality of contacts each positioned in a respective one of said passages, each said contact including a planar body portion, a matable terminal portion extending from one side of said body portion, a cantilever arm extending from another side of said body portion and lying substantially in the plane thereof, a forked projection on the free end of said arm, each said forked projection including at least two tines defining a plane offset with respect to the plane of said body portion and defining therebetween an insulation displacing slot, and at least one outwardly directed barb on the free end of each said tine;

a pair of mating housing members pivotally attached to said contact block and adapted to act against said contact arm and said cable to cause said projections to penetrate completely through the cable with the barbs lockingly engaging the opposite mating housing member whereby the conductors of said cable are entrapped and engaged by said tines;

a plurality of grooves in the mating face of one of said mating housing members, each groove adapted to frictionally engage respective arms of said contacts; and a slot in the other of said mating housing members closely adjacent the pivotal attachment to said contact block for through passage of said cable whereby said connector is attached intermediate the ends of said cable in daisy chain fashion.

2. A connector assembly according to claim 1 wherein each said groove has an enlarged portion at a blind end adapted to receive the angled forked projection of the associated contact.

3. A connector assembly according to claim 1 to further comprising:

clamping means encompassing three sides of said mating housing members and gripping the fourth side thereof whereby the cable is secured flat against said connector.

4. A connector assembly according to claim 1 further comprising:

a contact locking ridge extending transversely on each side mating housing member and adapted to lie closely adjacent a rear surface of said contact block when said members are in a closed condition.

5. A connector assembly according to claim 1 further comprising:

a housing shell surrounding said contact block, said shell including a hood portion having a forwardly directed flange encompassing and protecting said electrical connection terminals, a rear portion, and means securing said two portions together.

6. A connector assembly according to claim 5 wherein said rear portion of said housing shell and said contact block define upper and lower channels, each said mating housing member having an arcuate flange adapted to engage in a respective one of said channels whereby said members are pivotally attached to said connector block.

7. A connector assembly according to claim 6 wherein said mating housing members are of different transverse widths, further comprising keying means on the arcuate flange of the wider of said members and the associated channel preventing the insertion of the narrower member into the keyed channel.

8. A connector assembly according to claim 7 wherein said keying means comprises:

a slot formed in the arcuate flange of said wider member, and a fixed stud formed in said wider channel.

9. A connector assembly according to claim 1 further comprising:

strain relief means on said mating housing members.

10. A connector assembly according to claim 9 wherein said strain relief means comprises a plurality of interfitting transverse ridges on mating surfaces of said mating housing members forming a tortous path therebetween.

11. A connector assembly according to claim 10 further comprising:

locking means adapted to secure said mating housing members together in a closed condition.

12. A connector assembly according to claim 11 wherein said locking means are integral with said mating housing members.

13. A connector assembly according to claim 12 wherein at least a portion of said locking means is profiled to serve as guide means for the cable

* * * * *